US009181060B2

(12) United States Patent
Horie

(10) Patent No.: US 9,181,060 B2
(45) Date of Patent: Nov. 10, 2015

(54) RECORDING APPARATUS

(71) Applicant: SEIKO EPSON CORPORATION, Tokyo (JP)

(72) Inventor: Seijun Horie, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,244

(22) Filed: Mar. 24, 2014

(65) Prior Publication Data

US 2014/0292980 A1 Oct. 2, 2014

(30) Foreign Application Priority Data

Mar. 26, 2013 (JP) ..... 2013-063556

(51) Int. Cl.

| | |
|---|---|
| ***B65H 31/00*** | (2006.01) |
| ***B65H 31/22*** | (2006.01) |
| ***B41J 11/00*** | (2006.01) |
| ***B41J 13/10*** | (2006.01) |
| ***B41J 15/04*** | (2006.01) |

(52) U.S. Cl.

CPC ..... *B65H 31/00* (2013.01); *B41J 11/001* (2013.01); *B41J 13/106* (2013.01); *B41J 15/04* (2013.01); *B65H 31/22* (2013.01); *B65H 2402/31* (2013.01); *B65H 2402/32* (2013.01); *B65H 2405/1122* (2013.01); *B65H 2405/1124* (2013.01); *B65H 2801/36* (2013.01)

(58) Field of Classification Search

CPC .... B65H 31/00; B65H 31/22; B65H 2402/31; B65H 2402/32; B65H 2405/1122; B65H 2405/1124; B65H 2405/31; B65H 2801/36; B65H 31/20; B41J 11/001; B41J 13/106

See application file for complete search history.

(56) References Cited

U.S. PATENT DOCUMENTS

| | | | | |
|---|---|---|---|---|
| 6,568,865 | B1 * | 5/2003 | Fujioka et al. | 400/647.1 |
| 7,121,543 | B2 * | 10/2006 | Fujioka | 271/207 |
| 2005/0141939 | A1 * | 6/2005 | Kayama et al. | 399/405 |

FOREIGN PATENT DOCUMENTS

| | | | |
|---|---|---|---|
| JP | 07-061681 | A | 3/1995 |
| JP | 2008-094555 | A | 4/2008 |

* cited by examiner

*Primary Examiner* — Michael McCullough
(74) *Attorney, Agent, or Firm* — Global IP Counselors, LLP

(57) ABSTRACT

A recording apparatus includes a recording part configured to record onto a recording medium; a discharge part configured to discharge a recorded medium, which is the recording medium that has been previously recorded on; and a medium catcher part configured to catch the discharged recorded medium. The medium catcher part has a guide surface configured to guide a leading end of the discharged recorded medium toward a side (the direction of approach side) opposite to a discharge direction in which the recorded medium is discharged, at a lower side of the discharge part and is configured so that the guide surface is separable from the discharge part.

6 Claims, 7 Drawing Sheets

COMPARATIVE EXAMPLE

COMPARATIVE EXAMPLE

RECORDING APPARATUS

CROSS-REFERENCE TO RELATED APPLICATIONS

This application claims priority to Japanese Patent Application No. 2013-063556 filed on Mar. 26, 2013. The entire disclosure of Japanese Patent Application No. 2013-063556 is hereby incorporated herein by reference.

BACKGROUND

1. Technical Field

The present invention relates to a recording apparatus.

2. Related Art

Recording apparatuses such as large-scale inkjet printers include one where a recording paper that has been fed out from a roll of paper (a recording medium) is printed on, cut, and discharged from a discharge port, and the recording paper is allowed to fall into a paper catcher below the discharge port. A recorded recording medium catcher disclosed in Japanese Laid-open Patent Publication H7-61681 has a sheet-shaped member, one end of which is supported by a support member that can be pulled out from a leg part of a recording apparatus; the other end of the sheet-shaped member is supported by a hook of the leg part. This causes the sheet-shaped member to form a slackness that is substantially U-shaped as seen in side view.

In general, a roll of paper has a curl. The above-described recorded recording medium catcher assumes that the recorded recording medium is allowed to fall and the recorded recording medium is stacked in a state where the U-shaped curved surface of the sheet-shaped member and the orientation of the curl of the recorded recording medium have been aligned. However, the recorded recording medium that is being discharged may in some instances be long paper, and may in other instances be short paper. The case of a short recorded recording medium is more prone to rounding because of the curling of the recorded recording medium. For this reason, there is the risk of the inability for the recorded recording medium to be stacked in a desired state, such as when the recorded recording medium is stacked in a rounded state.

This problem is not limited to inkjet printers, and similarly affects a variety of recording apparatus.

SUMMARY

In view whereof, one objective of the present invention is to provide a recording apparatus with which both a long recorded medium and a short recorded medium can be suitably stacked.

In one aspect of the invention, a recording apparatus according to an aspect of the invention includes a recording part configured to record onto a recording medium, a discharge part configured to discharge a recorded medium, which is the recording medium that has been previously recorded on, and a medium catcher part configured to catch the discharged recorded medium, the medium catcher part having a guide surface configured to guide a leading end of the discharged recorded medium to a side opposite to a discharge direction in which the recorded medium is discharged, at a lower side of the discharge part, and being configured so that the guide surface is separable with respect to the discharge part.

That is to say, the leading end of the discharged recorded medium is guided to the side opposite to the direction of discharge of the recorded medium by the guide surface, at the lower side of the discharge part, and therefore when a plurality of recorded media are discharged, the leading ends of the recording media are aligned and suitably stacked. In a case where the recorded medium being discharged is long, having the guide surface be separable with respect to the discharge part allows for the long recorded medium to be suitable stacked. As such, the above-described aspect makes it possible to provide a recording apparatus with which both a long recorded medium and a short recorded medium can be suitable stacked.

Herein, the above-described recording apparatus encompasses inkjet printers, wire dot printers, laser printers, line printers, copy machines, facsimiles, and the like.

The lower side of the discharge part is not limited to being below in the vertical direction, but rather may be deviated from below in the vertical direction.

The recording apparatus may be provided with a housing to which the discharge part is provided, and leg part configured to support supporting the housing. In such a case, the medium catcher part may be provided so as to be slidable in a sliding direction that is along the discharge direction and an opposite direction opposite to the discharge direction with respect to the leg part. This aspect makes it possible to provide a suitable example for sliding the guide surface on the discharge part lower side, because the guide surface is slid in conformity with the sliding of the medium catcher part with respect to the leg part.

A rail oriented in the sliding direction of the medium catcher part may be provided, the medium catcher part being slidably mounted onto the rail. This aspect makes it possible to slide the guide surface with the simple configuration of the rail.

The medium catcher part may have a frame part slidably provided so as to slide to a side of discharge of the recorded medium and an opposite side thereof. The guide surface may be constituted of a sheet member that is mounted onto the frame part and with which a slack part is formed on the lower side of the discharge part. This aspect makes it possible to provide a convenient recording apparatus with which the sliding remains possible while the shape of the slack part is maintained, because the slack part of the sheet member slides in conformity with the sliding of the frame part.

The medium catcher part may be rotatable about a position of mounting onto the leg part, and may be movable to below the housing with an orientation running along the sliding direction. This aspect makes it possible to provide a recording apparatus with which the medium catcher part can be compactly stowed when not in use, because the medium catcher part can be rotated with an orientation running along its own direction of sliding and moved to below the housing.

The recording apparatus may be provided, at a lower part of the housing, with a medium support part configured to support supporting the recording medium which is conveyed to the recording part. The medium catcher part, which is further to the side of discharge of the recorded medium than the medium support part, may be able to rotate and move to below the housing with an orientation running along the sliding direction. This aspect allows for favorable access to the recording medium being supported by the medium support part and enables mass recording, because the medium catcher part, which is further to the side of discharge of the recorded medium than the medium support part, can be stowed below the housing.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention shall be described below. It shall be readily understood that the following embodiment is merely for illustratively exemplifying the present invention, and not all of the features illustrated in the embodiment are necessarily essential for the means of solving of the present invention.

Figure 1:
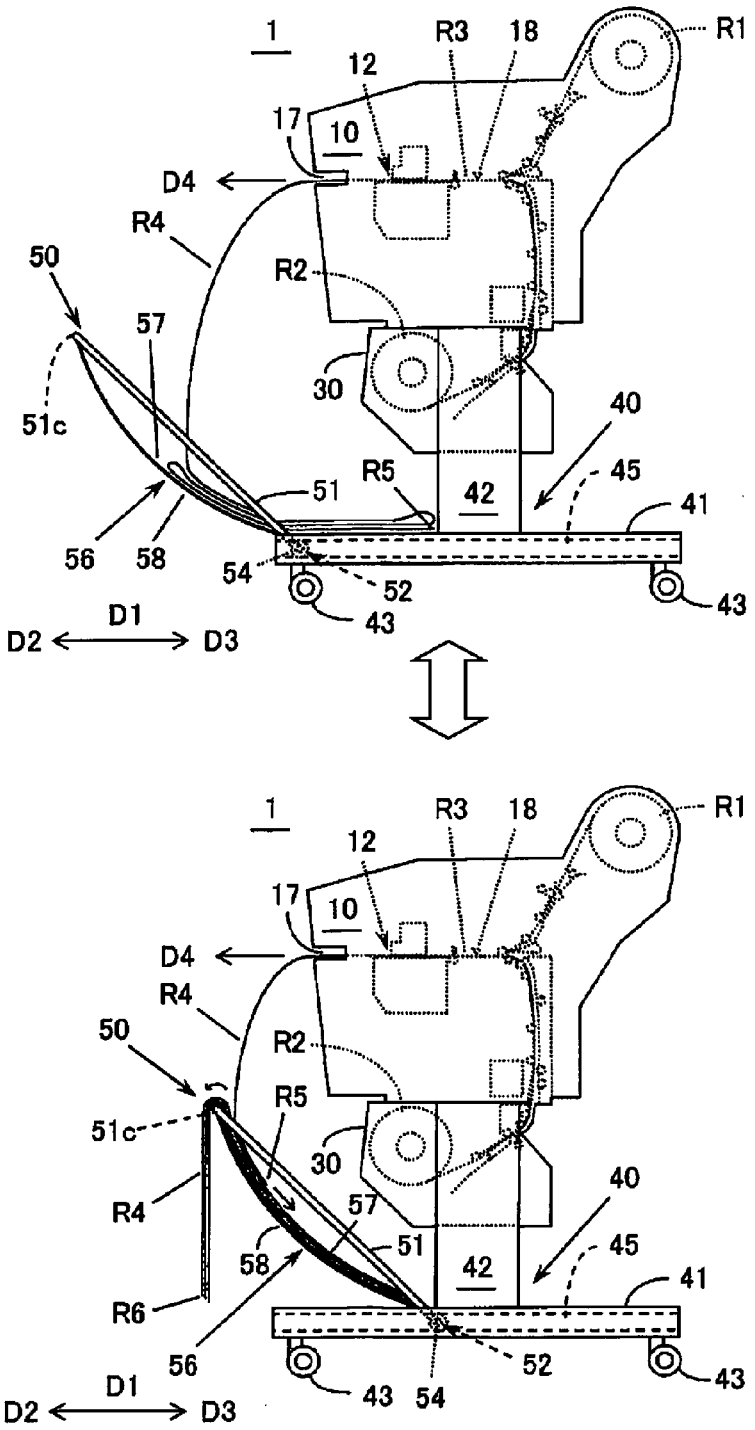
FIG. 1 is a side view schematically illustrating the manner in which a slide position of a stacker (medium catcher part) is changed and a recorded medium R4 is stacked.
Figure 2:
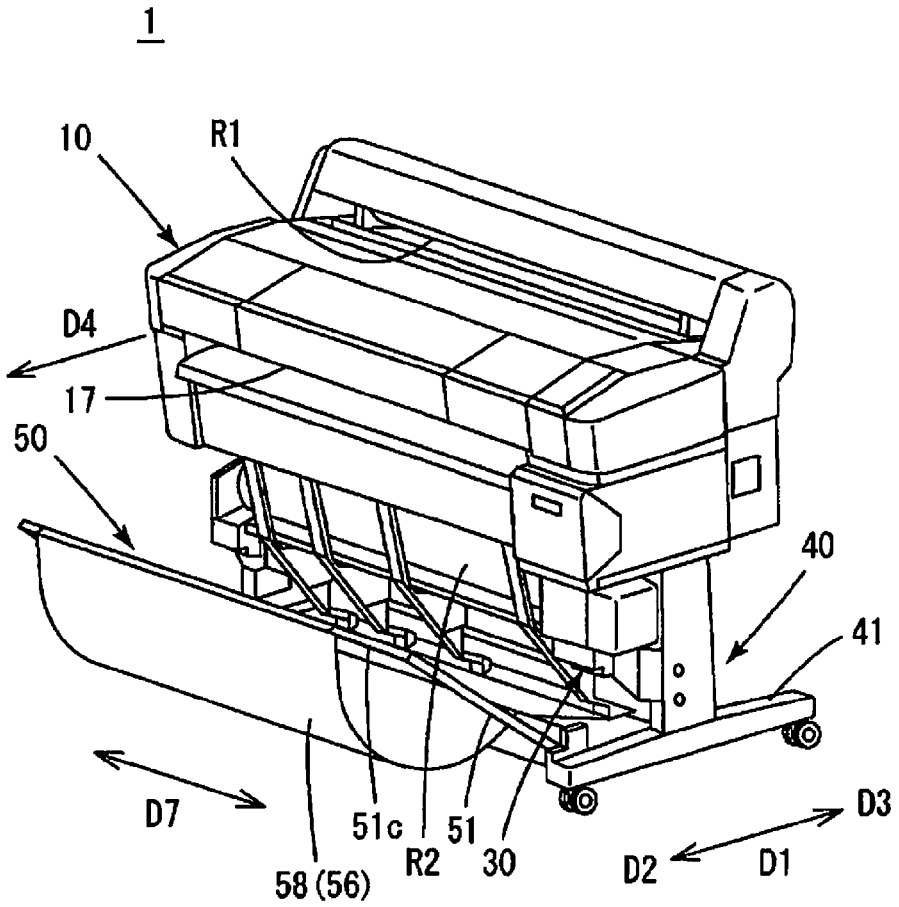
FIG. 2 is a perspective view illustrating the outer appearance of a recording apparatus 1.
Figure 3:
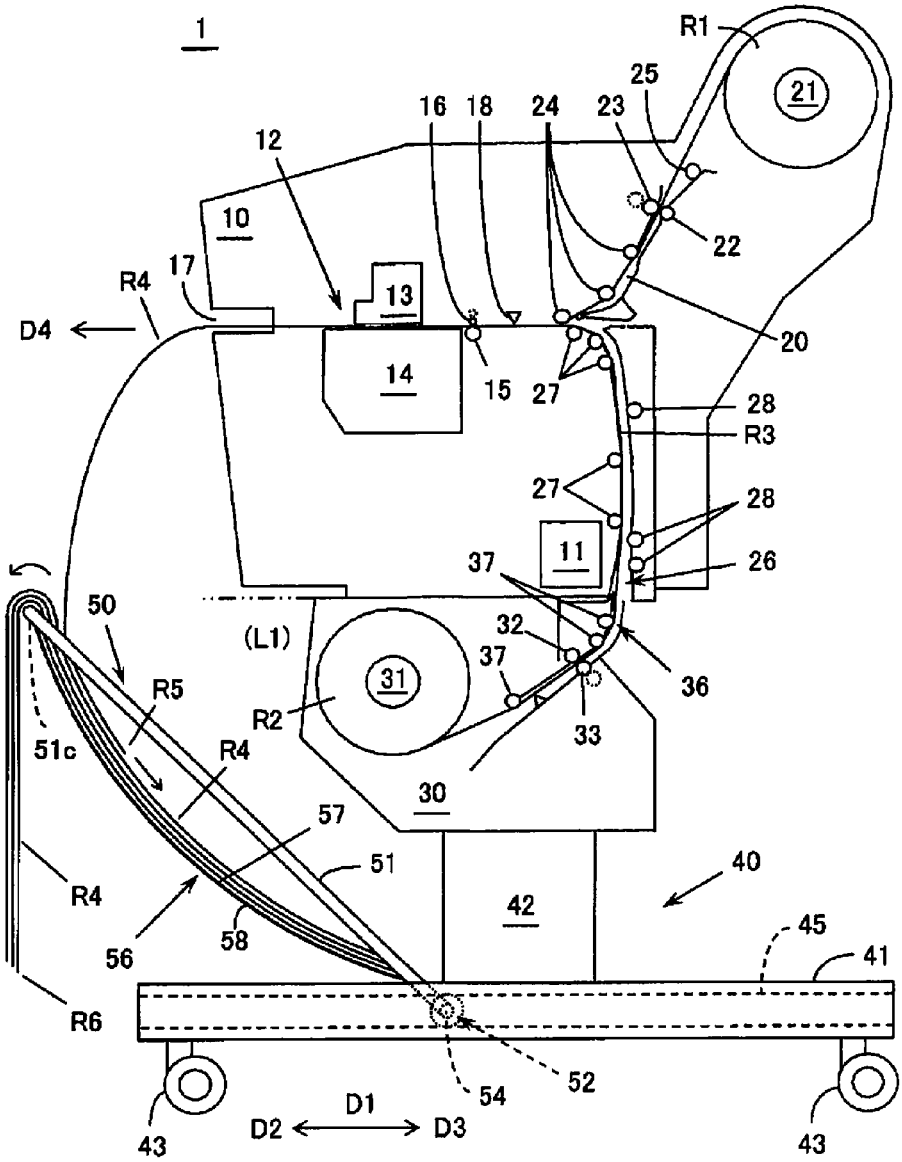
FIG. 3 is a vertical cross-sectional view illustrating the interior of the recording apparatus.
Figure 4:
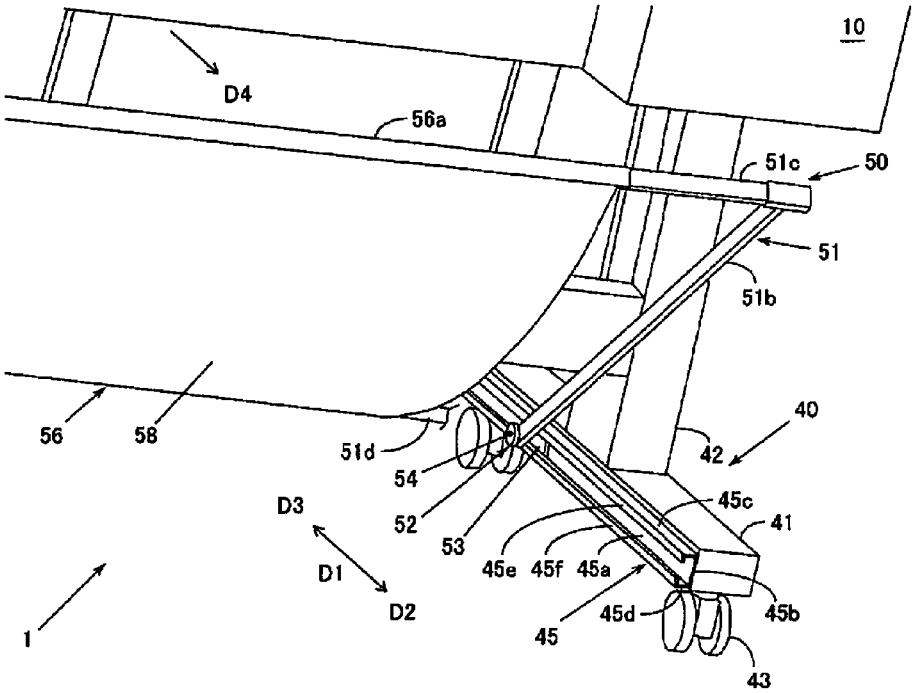
FIG. 4 is a perspective view illustrating principal parts of the recording apparatus 1.
Figure 5:
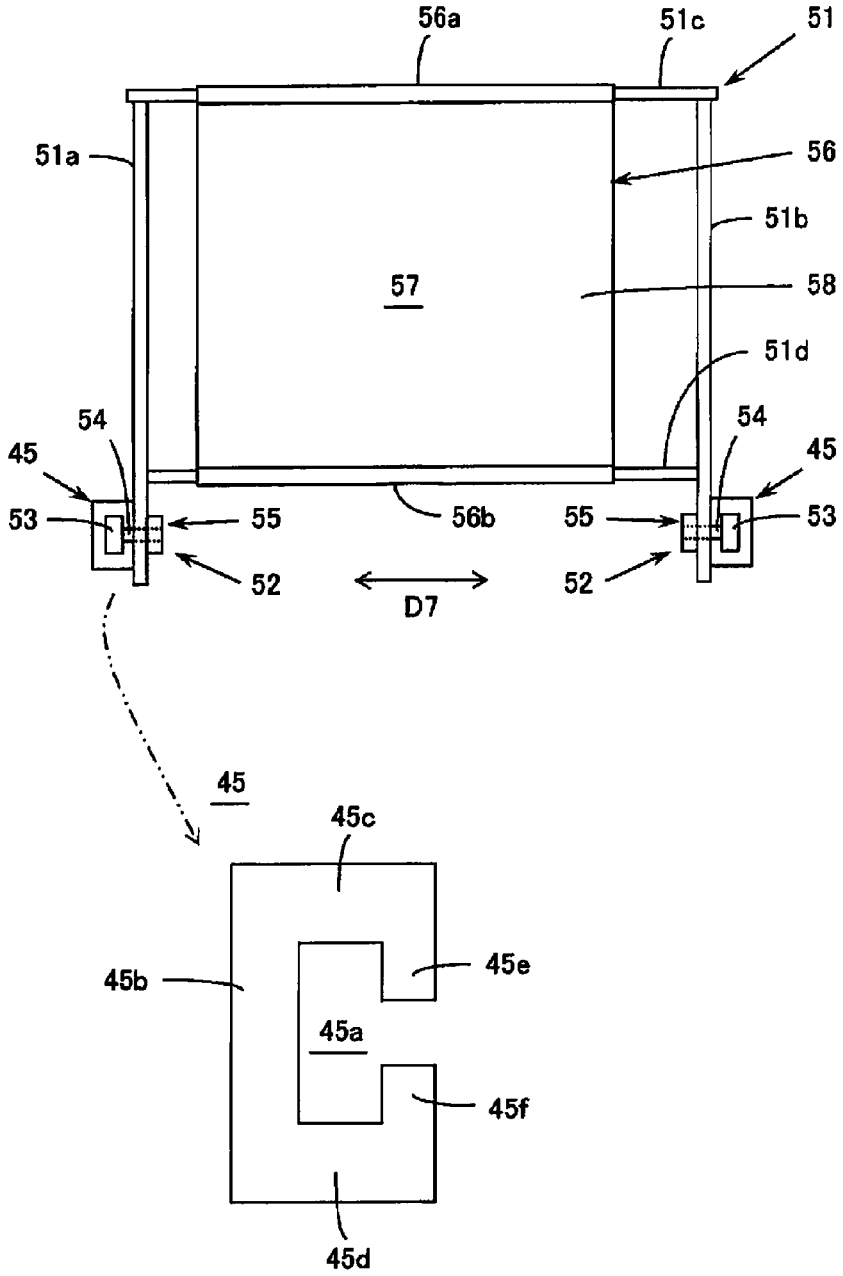
FIG. 5 is a rear view illustrating a stacker 50 and rails 45.
Figure 6A:
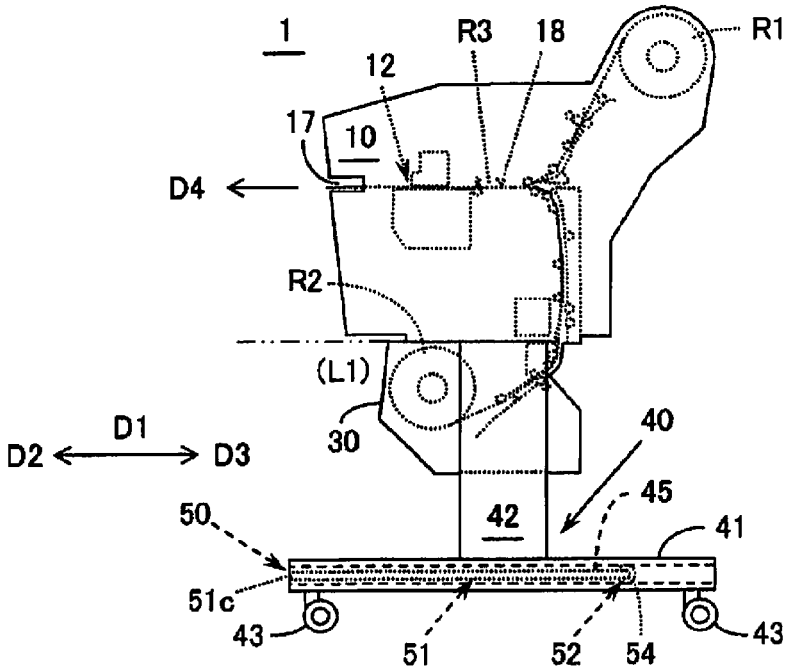
FIG. 6A is a side view illustrating the manner in which the stacker 50 is accommodated.
Figure 6B:
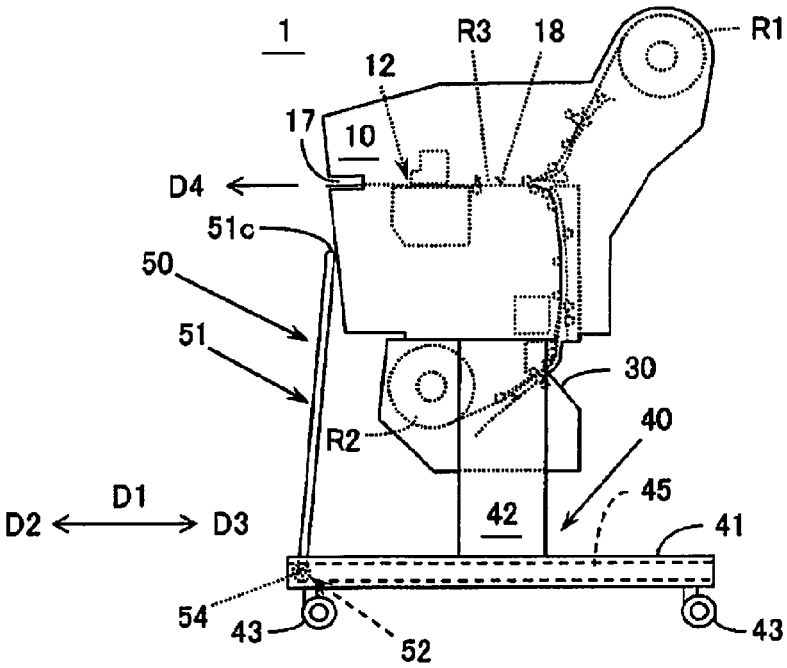
FIG. 6B is a side view illustrating the manner in which a pull-out side of a paper supply unit (medium support part) 30 is closed off with the stacker 50.

FIG. 1 is a side view schematically illustrating the manner in which a recorded medium R4 is stacked; the upper drawing illustrates the manner in which a stacker (medium catcher part) 50 is slid in a direction of separation D2 from a discharge part 17, and the lower drawing illustrates the manner in which the stacker 50 is slide in a direction of approach D3 toward the discharge part 17. FIG. 2 is a perspective view illustrating the outer appearance of a large-scale inkjet printer serving as a recording apparatus 1. FIG. 3 is a vertical cross-sectional view illustrating the interior of the recording apparatus with a cross-sectional view of a housing 10 comprising a paper supply unit (medium support part 30). FIG. 4 is a perspective view illustrating leg parts 40, the stacker 50, and the periphery therearound. FIG. 5 is a rear view illustrating the stacker 50 and rails 45; the lower drawing provides an enlarged view of a rail 45; FIGS. 6A and 6B are side views illustrating a state of non-use of the stacker 50.

In the drawings described above, the reference sign D1 is indicative of a direction of sliding of the stacker 50 in relation to the leg parts 40. The reference sign D2 is indicative of a direction of separation, which is one side in the direction of sliding. The direction of separation D2 is a direction of separation of a guide surface 57 of the stacker 50 in relation to the discharge part 17. The reference sign D3 is indicative of a direction of approach, which is the other side in the direction of sliding. The reference sign D4 is a direction of discharge of the recorded medium R4 from the discharge part 17. The depicted direction of discharge D4 is parallel to the direction of separation D2, but the direction of discharge D4 need not be parallel to the direction of separation D2. The reference sign D7 is indicative of a recording apparatus width direction orthogonal to the direction of discharge D4 as well as to the vertical direction. FIGS. 1, 3, and 6 are drawings in which the recording apparatus 1 is illustrated in side view from the outside of the width direction D7.

The drawings are in some instances not consistent with one another, for the sake of ease of understanding.

Moreover, the positional relationships described in the present description are merely illustrative examples for describing the invention, and are not for limiting the invention. As such, the present invention also encompasses arrangements of the paper supply unit at positions other than below the housing, e.g., above, to the left, or to the right.

"Identical", "orthogonal", or "equal" for directions, positions, and the like do not only signify strictly identical, orthogonal, or equal, but also encompasses errors that are produced during manufacture and the like.

The recording apparatus 1 illustrated in the drawings described above is provided with the housing 10, the leg parts 40 for supporting the housing 10, and the stacker 50 for receiving the recorded medium R4 discharged from the discharge part 17 of the housing 10. The stacker 50 has a guide surface 57 for guiding a leading end R5 of the discharged recorded medium R4 to a side (toward the direction of approach D3) opposite to the direction of discharge D4 of the recorded medium R4, at a lower side of the discharge part 17, and is configured so that the guide surface 57 is separable from the discharge part 17. For example, a relatively longer recorded medium can be favorably stacked when the stacker 50 is fixed to a sliding position on the direction of separation D2 side with respect to the leg parts 40, as illustrated in the upper drawing of FIG. 1. A relatively shorter recorded medium can be favorably stacked when the stacker 50 is fixed to a sliding position on the direction of approach D3 side with respect to the leg parts 40, as illustrated in the lower drawing of FIG. 1. The present recording apparatus 1 has a feature where the guide surface 57 for guiding the leading end R5 of the recorded medium to the direction of approach D3 side can be slidingly moved in the direction of separation D2 and in the direction of approach D3.

A paper supply unit 30 is slidably provided to a lower part of the housing 10, and the recording apparatus 1 illustrated in the drawings described above is able to print (record) switching between a first roll of paper R1 to the back of an upper part of the apparatus and a second roll of paper R2 of a lower part of the apparatus. The rolls of paper are continuous rolls where a recording medium has been wound into a roll. The outsides of both rolls of paper R1, R2 serve as print surfaces. It shall be readily understood that rolls of paper for which the inside is the print surface would also be used, when the positions of feed-out mechanisms 21, 31 are changed. For the rolls of paper, it would be possible to use a wound recording medium of a variety of substances, such as paper, fabric, plastic, or leather.

Also, though not depicted, the recording apparatus 1 could also print with cut paper inserted from a manual feed slot, the printed cut paper being discharged from the discharge part 17 as a short recorded medium R4 and stacked onto the stacker 50.

As illustrated in FIG. 3, the housing 10 having the paper supply unit 30 is provided, inter alia, with a control unit 11, a recording part 12, a conveyer roller pair (15, 16), the discharge part 17, a cutter 18, a medium path 20 and paper supply mechanism (21 to 25) for the first roll of paper, a first medium path 26 and second medium path 36 and paper supply mechanism (27, 28, 31 to 33, 37) for the second roll of paper. The paper supply unit 30 is able to slide between a stowed position L1 on the direction of approach D3 side and a pulled-out position on the direction of separation D2 side, and is electrically connected to the control unit 11. The paper supply unit 30 is a medium support part for supporting a recording medium R3 being conveyed to the recording part 12, and is provided to a lower part of the housing 10.

The control unit 11 has a central processing unit (CPU), read-only memory (ROM), random access memory (RAM), and the like, and controls the operations of each of the parts of the recording apparatus 1, such as accepting a command for recording output from an external host apparatus and printing onto the recording medium. The recording medium intended for printing is a portion that has been pulled out from either of the rolls of paper R1, R2; in the case of the second roll of paper R2, the recording medium intended for printing is the continuous recording medium R3.

The recording part 12 has a recording head 13 and a platen 14. The recording head 13 is arranged on an upper side facing the platen 14, and is able to record by discharging an ink onto the recording medium. The platen 14 supports the recording medium, and gives a predetermined distance between the recording medium and the recording head 13.

The conveyer roller pair 15, 16 are provided with a drive roller 15 arranged on the lower side and a driven roller 16 arranged on the upper side. The driven roller 16 is separable from the drive roller 15, and when nearby nips the recording medium along with the drive roller 15.

The recording medium, which is sent out from the discharge part 17, is cut with the cutter 18 and released from the nipping between the conveyer roller pair (15, 16), and thereupon stacked on the stacker 50.

The paper supply mechanism for the first roll of paper is provided, inter alia, with a feed-out mechanism 21 for supporting the first roll of paper R1, a paper supply roller pair (22, 23), rolling rollers (driven rollers) (24, 25). The paper supply roller pair (22, 23) is provided with a drive roller 22 that is arranged on an outer peripheral side of the medium path 20, and a driven roller 23 that is arranged on an inner peripheral side of the medium path 20. The driven roller 23 is separable from the drive roller 22, and when nearby nips the recording medium along with the drive roller 22.

During the supply of a fresh first roll of paper R1 that has been mounted onto the feed-out mechanism 21, a user would first place the leading end of the roll of paper R1 between the paper supply roller pair (22, 23). Thereafter, the feed-out mechanism 21 feeds the roll of paper R1 out, and the recording medium that is fed out is nipped by the paper supply roller pair (22, 23) and conveyed toward the conveyer roller pair (15, 16); the conveyer roller pair (15, 16) then nip the recording medium. During printing, the conveyer roller pair (15, 16) conveys the recording medium over the platen 14, and the recording head 13 discharges ink and records onto the recording medium.

The paper supply mechanism of the second roll of paper is provided, inter alia with a feed-out mechanism 31 for supporting the second roll of paper R2, a paper supply roller pair (32, 33), and rolling rollers (driven rollers) (27, 28, 37). The paper supply roller pair (32, 33) is provided with a drive roller 32 that is arranged on an inner peripheral side of the second medium path 36, and a driven roller 33 that is arranged on an outer peripheral side of the second medium path 36. The driven roller 33 is separable from the drive roller 32, and when nearby, nips the recording medium R3 along with the drive roller 32.

During the supply of a fresh second roll of paper R2 that has been mounted onto the feed-out mechanism 31, a user would first place the leading end R5 of the roll of paper R2 between the paper supply roller pair (32, 33). Thereafter, the feed-out mechanism 31 feeds the roll of paper R2 out, and the recording medium R3 that is fed out is nipped by the paper supply roller pair (32, 33) inside the second medium path 36 and conveyed toward the first medium path 26. The conveyer roller pair (15, 16) then nips the recording medium R3 that has passed through the first medium path 26 and been conveyed between the conveyer roller pair (15, 16). Thereafter, the paper supply roller pair (32, 33) may then release the recording medium R3 from the nip. During printing (recording), the conveyer roller pair (15, 16) conveys the recording medium over the platen 14, and the recording head 13 discharges ink and records onto the recording medium R3. The series of operations is controlled by the control unit 11.

The drive rollers and driven rollers constituting the roller pairs may have the reverse arrangements of the positional relationships described above. Also, using a drive roller instead of a driven roller, the roller pairs may be constituted of pairs of drive rollers.

At both end portions of the recording apparatus 1 in the width direction D7, the leg parts 40 each include an elongated part 41, an extending part 42, and casters (43, 43), and support the housing 10. The longitudinal direction of each of the elongated parts 41 is oriented toward the direction of sliding of the stacker 50, as illustrated in FIGS. 1 to 4. Each of the extending parts 42 extends upward from a substantially middle position of the elongated parts 41 up to the housing 10. The casters 43, 43 are mounted onto both ends of each of the elongated parts 41 in the direction of sliding D1.

Rails 45 oriented in the direction of sliding D1 of the stacker 50 are mounted onto an inside surface of each of the elongated parts 41 in the width direction D7. As illustrated in FIG. 5, each of the rails 45 has a base part 45*b* contacted against the elongated parts 41, extending parts (45*c*, 45*d*) extending from upper and lower edges of the base parts 45*b* toward the inside in the width direction D7, and folded parts (45*e*, 45*f*) extending in the direction of mutual approach from leading end edges of the extending parts (45*c*, 45*d*). The portions surrounded by these parts 45*b* to 45*f* are understood to be grooves 45*a* where the folded parts 45*e*, 45*f* are opened.

The stacker (medium catcher part) 50 has a frame part 51, rotating slide mechanisms (52, 52), and a sheet member 56, and receives the recorded medium R4 that is discharged from the discharge part 17.

As illustrated in FIG. 5, the frame part 51 has side parts (51*a*, 51*b*) arranged at both side portions in the width direction D7, a support part 51*c* for coupling ends of the side parts (51*a*, 51*b*) on sides opposite to rotating shafts 54, and a support part 51*d* for coupling near the rotating shafts 54 on the side parts (51*a*, 51*b*). The side parts 51*a*, 51*b* are rod-shaped or cylindrical members for which the longitudinal direction is oriented toward a direction substantially orthogonal to the width direction D7, and are rotatable about the rotating shafts 54. The support parts 51*c*, 51*d* are rod-shaped or cylindrical members for which the longitudinal direction is oriented in the width direction D7.

Each of the rotating slide mechanisms 52 has a slider 53, a rotating shaft 54, and a holding mechanism 55, and is slidable along the rails 45 while maintaining the angles of the side parts 51*a*, 51*b*. The sliders 53 are inserted so as not to rotate into the grooves 45*a* of the rails 45, and are guided by the grooves 45*a* to slide in the direction of separation D2 and direction of approach D3. The rotating shafts 54 are sites at which the side parts 51*a*, 51*b* are rotated with respect to the sliders 53, and are central axes of rotation of the stacker 50. The holding mechanisms 55 are able to hold the positions of rotation of the side parts 51*a*, 51*b* with respect to the sliders 53, and allow for the positions of rotation of the side parts 51*a*, 51*b* to be held or for this holding to be released, depending on the operation of a user.

Due to the foregoing reasons, the stacker 50 is mounted onto the rails 45 so as to be slidable toward the side of discharge of the recorded medium R4 (the direction of separation D2) and the opposite side thereof (the direction of approach D3), and is rotatable about the positions of mounting onto the leg parts 40.

The sheet member 56 is formed of a flexible sheet-shaped member made of fabric, plastic, or the like, and the rear side thereof serves as the guide surface 57 for guiding the leading end R5 of the recording medium. That is to say, the guide surface 57 is constituted of the sheet member 56, and as illustrated in FIGS. 1 and 3, guides the leading end R5 of the recording medium that has been discharged from the discharge part 17, toward the direction of approach D3 side at the lower side of the discharge part 17. Edges 56*a*, 56*b* on the upstream side and downstream side of the sheet member 56 in the direction of guiding are each supported by the support parts 51*c*, 51*d*. For example, the edges 56*a*, 56*b* can be supported by folding the edges 56*a*, 56*b* so as to be able to pass through the support parts 51*c*, 51*d*, thus forming an insertion-receiving part, and inserting the support parts 51*c*, 51*d* into the insertion-receiving part. The edges 56*a*, 56*b* could also be supported by forming grooves in the support parts 51*c*, 51*d* so that the edges 56*a*, 56*b* can be inserted, and then inserting the edges 56*a*, 56*b* into the grooves.

For the foregoing reasons, the sheet member 56 is mounted onto the frame part 51.

As illustrated in FIGS. 1 to 4, a slack part 58 that is downwardly convex on the lower side of the discharge part 17 is formed in the flexible sheet member 56. The rear side of the slack part 58 is the guide surface 57. The slackened shape of the guide surface 57 guides the leading end R5 of the recorded medium R4 smoothly toward the direction of approach D3 side. When the stacker 50 slides, the slackened shape of the guide surface 57 is still maintained, because the sheet member 56 that has the slack part 58 is mounted onto the frame part 51 and the frame part 51 is provided so as to be able to slide in the direction of separation D2 and the direction of approach D3 with respect to the leg parts 40.

As illustrated in FIG. 6A, the rotating slide mechanisms 52 are able to cause the frame part 51 to rotate with an orientation running along the direction of sliding D1, and the frame part 51 can be slid in the direction of approach D3 while this orientation is upheld. That is to say, the stacker 50 can be moved to below the paper supply unit 30 (the housing 10) at a stowed position with an orientation running along its own direction of sliding D1, and can be stowed at a position below the paper supply unit 30. Herein, during stacking of the recorded medium R4, the stacker 50 is further to the side of discharge of the recorded medium R4 (the direction of discharge D4 side) than the paper supply unit 30, and the stacker 50 in this state is able to rotate toward the direction of separation D2 side and move to below the paper supply unit 30 at the stowed position with an orientation running along its own direction of sliding D1.

The orientation running along the direction of sliding D1 described above is not limited to being an orientation that matches the direction of sliding D1, but rather may be an orientation that is closer to the direction of sliding D1 than the orientation of the frame part 51 when the guide surface 57 is guiding the leading end R5 of the recorded medium R4, and encompasses also orientations that deviate from the direction of sliding D1 with a predetermined range (for example, within 15°).

Also, as illustrated in FIG. 6B, the rotating slide mechanisms 52 are also able to cause the frame part 51 to rotate more toward the direction of approach D3 side. That is to say, the stacker 50 is able to slide as well as rotate to a position at which the pullout side (direction of separation D2 side) of the paper supply unit 30 is blocked off.

Figure 7A:
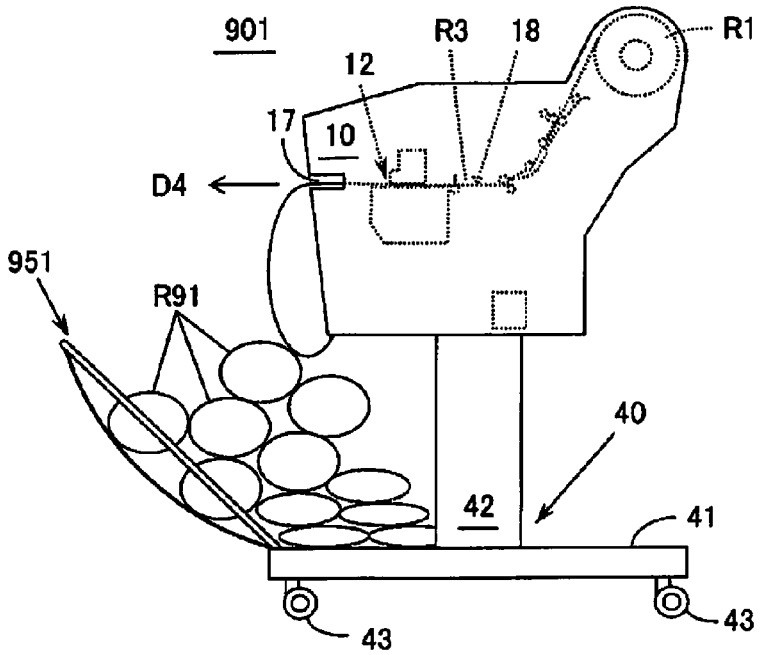
FIG. 7A is a side view schematically illustrating the manner in which a recorded medium is stacked in a comparative example.

Now, in a case where a relatively longer recorded medium is being stacked, the recorded medium R4 is folded and favorably stacked within the stacker 50 when the stacker 50 is at the direction of separation D2 side, as illustrated by the upper drawing in FIG. 1. However, the recorded medium being discharged from the discharge part 17 may in some instances be long and in other instances may be short. Here now is a comparison with a recording apparatus 901 of a comparative example in which a stacker 951 corresponding to a longer recorded medium cannot be slid to the discharge part 17 side, as illustrated in FIG. 7A. A relatively shorter recorded medium R91 is more susceptible to rounding because of the curling of the recorded medium R91, and therefore when discharged from the discharge part 17 ends up being rounded inside the stacker 951. For this reason, there is a limited number of sheets of the short recorded medium R91 that are stacked, and in some instances the recorded medium R91 on the bottom ends up being crushed and broken.

Figure 7B:
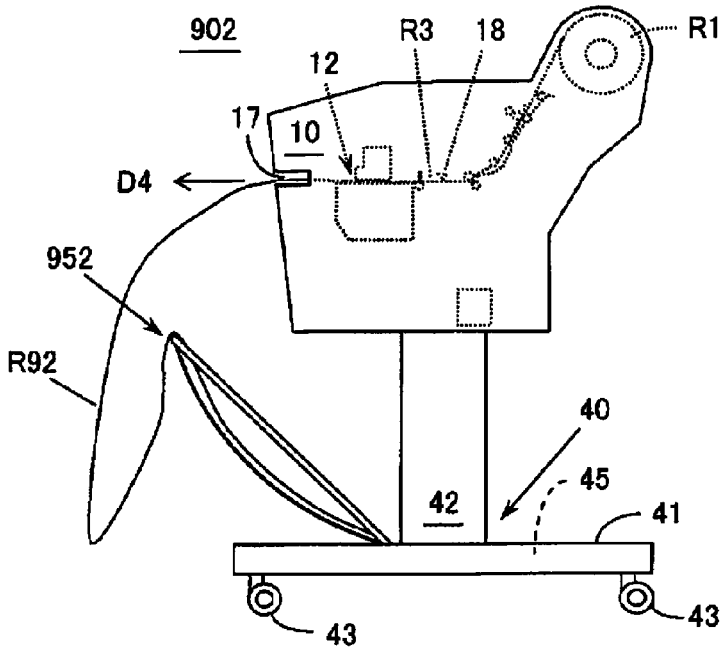
FIG. 7B is the side view schematically illustrating the manner in which the recorded medium is stacked in the comparative example.

In a case where a relatively shorter recorded medium is being stacked, however, the recorded medium R4 being discharged from the discharge part 17 is favorably discharged, being, for example, caught onto the upstream side edge 56*a* of the sheet member 56 of the stacker 50, provided that the stacker 50 is on the direction of approach D3 side, as illustrated by the lower drawing in FIG. 1. This is because the leading end R5 of the recorded medium R4 is guided to the direction of approach D3 side along the guide surface 57, and upon exiting from the discharge part 17, the trailing end R6 of the recorded medium R4 moves to the direction of separation D2 side. Here now is a comparison with a recording apparatus 902 of a comparative example in which a stacker 952 corresponding to a shorter recorded medium cannot be slid to the side opposite to the discharge part 17, as illustrated in FIG. 7B. When discharged from the discharge part 17, the relatively longer recorded medium R92 does not enter into the stacker 952 and ends up protruding out from the stacker 952.

The recorded recording medium catcher disclosed in Japanese Laid-open Patent Publication H7-61681 is a structure merely where the recorded recording medium falls and is stacked. As such, in the case of a shorter recorded recording medium, there is a risk that the recorded recording medium cannot be stacked in the desired form, such as when the recorded recording medium is stacked in a rounded state.

The present recording apparatus 1 is able to solve the disadvantage described above, because the stacker 50 having the guide surface 57 is provided so as to be able to slide in the direction of separation D2 and the direction of approach D3.

Actions and effects of the recording apparatus 1 shall be described next, with reference to FIGS. 1 to 6.

When the recorded medium R4 is discharged from the discharge part 17, the leading end R5 of the recorded medium R4 is guided in a direction deviated to the direction of approach D3 side on the side opposite to the direction of discharge D4 of the recorded medium R4 from below, due to the guide surface 57, at the lower side of the discharge part 17.

Here, in the case where the recorded medium R4 is relatively longer, the stacker 50 need only be slid to the direction of separation D2 side, as illustrated in the upper drawing in FIG. 1. In such a case, because inside the stacker 50 is broad in the direction of sliding D1, the recorded medium R4 does not protrude out from the stacker 50, but rather is favorably stacked, folded so as to repeatedly fold back in the direction of sliding D1 within the stacker 50.

In the case where the recorded medium R4 is relatively shorter, then the stacker 50 needly only be slid to the direction of approach D3 side, as illustrated by the lower drawing in FIG. 1. In such a case, the leading end R5 of the recorded medium R4 being discharged from the discharge part 17 is guided along the guide surface 57 in a direction deviated to the direction of approach D3 side from the downward direction, and when the trailing end R6 exits from the discharge part 17, the trailing end R6 moves to the direction of separation D2 side and is caught onto the upstream side edge 56*a* of the sheet member 56. When the short recorded medium R4 is repeatedly discharged, the plurality of recorded media R4 catching onto the upstream side edge 56*a* of the sheet member have the leading ends R5 aligned at a lower part inside the stacker 50, and the trailing ends R6 aligned in a state of having hung down at the upstream side edge 56*a* of the sheet member. As such, the plurality of recorded media R4 are not rounded inside the stacker 50 but rather are suitably stacked.

For the foregoing reasons, the present recording apparatus 1 is able to suitably stack both longer recorded media R4 and shorter recorded media R4.

Also, because the stacker 50 is mounted onto the rails 45 provided to the leg parts 40 so as to be able to slide in the direction of separation D2 and the direction of approach D3, the guide surface 57 slides in the direction of separation D2 and in the direction of approach D3 in conformity with the sliding of the stacker 50 with respect to the leg parts 40. As such, the present recording apparatus 1 is able to slide the guide surface 57 at the lower side of the discharge part 17 with the simple configuration of the rails 45, and able to suitably stack both longer and shorter recorded media.

Moreover, the shape of the slack part 58 can be maintained even when the stacker 50 slides, because the sheet member 56 is mounted onto the frame part 51 that is slidably provided and the sheet member 56 forms on the lower side of the discharge part 17 the slack part 58 that serves as the guide surface 57. As such, the present recording apparatus 1 is a convenient apparatus that makes it possible to maintain a favorable slackened shape of the guide surface 57 even when the medium catcher part 50 is slid.

Also, the stacker 50 moves with an orientation running along its own direction of sliding D1 about the positions of mounting onto the leg parts 40, and can be moved with this orientation to below the housing 10, as illustrated in FIG. 6A. As such, the present recording apparatus 1 allows for the medium catcher part 50 to be compactly stowed when not in use.

It is also possible for the stacker 50 to be further on the direction of discharge D4 side than the paper supply unit 30 of the lower part of the housing 10, and for the stacker 50 to rotate and move to below the housing 10 at an orientation running along its own direction of sliding D1. When the roll of paper (recording medium) R2 that is supported by the paper supply unit 30 is being accessed, the stacker 50 need only be rotated at an orientation running its own direction of sliding D1 and stowed to below the housing 10 to pull out the paper supply unit 30. As such, the present recording apparatus 1 allows for favorable access to the recording medium R2 being supported by the medium support part 30, and enables mass recording.

Additionally, the pullout side of the paper supply unit 30 can be blocked off as illustrated in FIG. 6B when the stacker 50 is rotated to the direction of approach D3 side with the slide position on the direction of separation D2 side illustrated in the upper drawing of FIG. 1. As such, the present recording apparatus 1 has a favorable outer appearance during non-use, and is a convenient apparatus enabling a variety of uses corresponding to the slide position and rotational position of the stacker 50.

With the present invention, a variety of modification examples are conceivable.

For example, beyond rolls of paper, the recording media that can be applied to the present invention may be a folded-over continuous paper or the like.

Beyond an apparatus for switching between a plurality of recording media to carry out recording, the recording apparatus may also be an apparatus for recording onto a single recording medium.

Though the medium catcher part is suitable because of the possibility of a variety of uses when rotation is enabled, as described above, the effect of being able to suitably stack both longer and shorter recorded media is still obtained when rotation is not enabled, provided that the guide surface be separable with respect to the discharge part.

Also, though having the guide surface be constituted of a sheet member that forms a slack part is suitable because the leading end of the recorded medium is then smoothly guided to the side opposite to the side of discharge of the recorded medium, the effect of being able to suitably stack both longer and shorter recorded media is still obtained even when there is no slack part, provided that there is the guide surface.

Though having the above-described rails be provided to the leg parts below the housing is suitable because the space below the housing can then be used as a space for stacking the recorded medium, the effect of being able to suitably stack both longer and shorter recorded media is still obtained even when the rails are provided to the housing, provided that the guide surface is separable with respect to the discharge part. Beyond the above-described rails, it shall be readily understood that for the means for making it possible to slide the medium catcher part, a variety of means can be employed, such as a structure where, for example, a rod-shaped member is inserted into an elongated cylindrical member.

As described above, according to the present invention, a variety of modes make it possible to provide, inter alia, a feature where both a longer recorded medium and a shorter recorded medium can be suitably stacked. It shall be readily understood that the fundamental actions and effects described above are also obtained with, inter alia, a feature that lacks the constituent elements as in the dependent claims and is composed only of the constituent elements as in the independent claim.

It would moreover be possible to implement, inter alia, a configuration where each of the configurations disclosed in the above-described embodiment and modification examples are substituted with one another or the combinations thereof are altered, or a configuration where each of the configurations disclosed in the known art and in the above-described embodiment and modification examples are substituted with one another or the combinations thereof are altered. The present invention also encompasses these configurations and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a recording part configured to record onto a recording medium;

a discharge part configured to discharge a recorded medium, which is the recording medium that has been previously recorded on; and a leg part supporting the recording part and the discharge part; and a medium catcher part configured to catch the discharged recorded medium, the medium catcher part having a guide surface configured to guide a leading end of the discharged recorded medium to an opposite direction opposite to a discharge direction in which the recorded medium is discharged, at a lower side of the discharge part, being configured such that the guide surface is separable with respect to the discharge part, and being slidably arranged relative to the leg part to move in a sliding direction that is along the discharge direction and the opposite direction, a distance between the discharge part and the guide surface increasing as the medium catcher part moves in the discharge direction, the medium catcher part having a frame part slidably provided so as to slide to a side of discharge of the recorded medium and an opposite side thereof, and the guide surface being constituted of a sheet member that is mounted onto the frame part and with which a slack part is formed on the lower side of the discharge part.

2. The recording apparatus according to claim 1, further comprising a housing to which the discharge part is provided, the leg part further supporting the housing.

3. The recording apparatus according to claim 2, wherein a rail oriented in the sliding direction of the medium catcher part is provided, and the medium catcher part is slidably mounted onto the rail.

4. The recording apparatus according to claim 2, wherein the medium catcher part is rotatable about a position of mounting onto the leg part, and is movable to below the housing with an orientation running along the sliding direction.

5. The recording apparatus according to claim 4, further comprising a medium support part disposed at a lower part of the housing and configured to support the recording medium which is conveyed to the recording part, the medium catcher part, which is further to the side of discharge of the recorded medium than the medium support part, being able to rotate and move to below the housing with an orientation running along the sliding direction.

6. A recording apparatus comprising:

a recording part configured to record onto a recording medium;

a discharge part configured to discharge a recorded medium, which is the recording medium that has been previously recorded on; and a leg part supporting the recording part and the discharge part; and a medium catcher part configured to catch the discharged recorded medium, the medium catcher part having a guide surface configured to guide a leading end of the discharged recorded medium to an opposite direction opposite to a discharge direction in which the recorded medium is discharged, at a lower side of the discharge part, being configured such that the guide surface is separable with respect to the discharge part, and being slidably arranged relative to the leg part to move in a sliding direction that is along the discharge direction and the opposite direction, a distance between the discharge part and the guide surface increasing as the medium catcher part moves in the discharge direction, the medium catcher part further having an axle that is slidably attached to the leg part such the axle moves in the sliding direction, and the medium catcher part being configured to pivot about the axle.

* * * * *